US005086199A

United States Patent [19]

Takano

[11] Patent Number: 5,086,199

[45] Date of Patent: Feb. 4, 1992

[54] LEVER SWITCH

[75] Inventor: Tsunesuke Takano, Tokyo, Japan

[73] Assignee: Daiichi Denso Buhin Co., Ltd., Tokyo, Japan

[21] Appl. No.: 521,430

[22] Filed: May 10, 1990

[30] Foreign Application Priority Data

May 15, 1989 [JP] Japan ..... 1-55678
May 25, 1989 [JP] Japan ..... 1-60729

[51] Int. Cl.[5] ..... H01H 15/02; H01H 9/00

[52] U.S. Cl. ..... 200/563; 200/275; 200/339; 200/315; 200/317; 200/6 R

[58] Field of Search ..... 200/563, 553, 560, 562, 200/310, 315, 317, 339, 6 R, 275, 260, 257, 255

[56] References Cited

U.S. PATENT DOCUMENTS

| | | | |
|---|---|---|---|
| 1,422,447 | 7/1922 | Kelsay | 200/6 R |
| 1,673,385 | 6/1928 | Wurdack | 200/563 |
| 2,617,911 | 11/1952 | Carey et al. | 200/6 R |
| 3,283,088 | 11/1966 | Scow | 200/317 |
| 3,519,776 | 7/1970 | Slater | 200/562 |
| 3,858,012 | 12/1974 | Lockard | 200/339 |
| 4,000,383 | 12/1976 | Lockard | 200/339 |
| 4,272,662 | 6/1981 | Simpson | 200/275 |
| 4,778,964 | 10/1988 | Kamisada | 200/275 |

FOREIGN PATENT DOCUMENTS

| | | | |
|---|---|---|---|
| 245084 | 2/1966 | Austria | 200/6 R |
| 522099 | 10/1955 | Belgium | 200/563 |
| 732359 | 3/1943 | Fed. Rep. of Germany | 200/553 |
| 2565402 | 12/1985 | France | 200/315 |

*Primary Examiner*—Henry J. Recla

*Assistant Examiner*—Keith Kupferschmid

*Attorney, Agent, or Firm*—Nixon & Vanderhye

[57] ABSTRACT

A switch device includes an insulating base formed of a plastics material which defines upper and lower switch operation spaces, a pair of confronting hinge bosses interposed between the upper and lower switch operating spaces, and a lamp-mounting space. An operation lever having upper and lower ends is pivotally coupled to the hinge bosses such that the upper end extends into the upper switch operation space and a lower end extends into the lower switch operating space. In this manner, the operation lever may be pivotally moved between first and second states. The lower end of the operation lever includes a bridge portion which establishes a hole such that an an opposed pair of resilient contact members associated with a U-shaped movable contact are disposed adjacent to the hole and are thereby capable of being resiliently displaced therewithin. A lamp-holding connector is mounted to the base for holding a lamp within a lamp-mounting space. First and second fixed contacts form an electrical circuit through the lamp held by the lamp-holding connector and are disposed within the lower switch operating space such that the resilient contact members of the U-shaped movable contact makes electrical contact with the first and second fixed contacts when the operation lever is in the first state, and breaks electrical contact between the first and second fixed contacts when the operation lever is in the second state. As such, an electrical circuit is made and broken to turn a lamp held by the lamp-holding connector on and off, respectively.

3 Claims, 10 Drawing Sheets

LEVER SWITCH

FIELD OF THE INVENTION

The present invention relates to a lever switch for use in switching interior automotive lamps or the like.

BACKGROUND OF THE INVENTION

Lamps equipped with a lever switch have been disclosed, for example, in Japanese Patent Publication No. 57-22633. The conventional switch lamp structure disclosed therein generally includes a pair of sockets formed by bending a plate in such a manner that the central portion of the plate becomes the bottom. The socket has a pair of confronting fastening members each of which has a fastening hole. The base has socket-insertion holes formed at predetermined intervals, each of which has a projection formed its confronting inner surfaces which can be fitted within the fastening hole formed in each of the pair of fastening members. A switch lever is fastened to the base and an elastic member constituting a switch mechanism is structured in such a manner that an end portion thereof is secured to the base at a position between either of the sockets and the switch lever. Another end portion of the elastic member is arranged to be brought into selected contact with the fastening members of either of the sockets.

The conventional switch structure described above has been developed so as to be used mainly as an interior automotive lamp. However, since the switch lever projects horizontally over the base (which is formed flat so that a lamp may be mounted thereto), the switch lever must be moved parallel to the flat base surface. Therefore, handling of the switch lever has been inefficient. What is even worse, however, is that the supporting shaft mechanism portion of the lever can be easily worn after it has been used frequently for a prolonged period of time, especially in the case where the supporting shaft mechanism is made of a plastics material. Therefore, manufacturing the conventional switch described above has been relatively complicated since the lever must be caulked and/or deformed in order to prevent separation of the lever.

SUMMARY OF THE INVENTION

Accordingly, an object of the present invention is to improve the handling and assembling of automotive switches by employing a structure arranged in such a manner that the operation lever of the switch is oriented substantially perpendicularly to the switch base.

This object can be achieved by a base formed of a plastics material and having insulating characteristics, and hinge bosses confronting each other which are disposed between upper and lower spaced formed in the base. An operation lever is pivotally fastened in such a manner that the hinges are elastically inserted into holes (recessed positions) formed in hinged members which are positioned in confronting relationship to the hinge bosses. A bridge member connects the lower portions of a hole (recessed portion) formed in the lower portion of the operation lever. A substantially U-shaped movable contact is pivotally fastened to the bridge member and is equipped with a pair of contacts confronting the hole (recessed portion) formed in the operation lever. First and second fixed contacts are fastened to the base with the movable contact being positioned therebetween. A lamp-holding connector includes a female connection portion from which the first fixed contact integrally projects or into which a portion of the first fixed contact is inserted. A securing portion is disposed in the base so as to securely mount the lamp-holding connector.

The common operation of the lever switch devices according to the present invention is such that when the operation lever is pivoted with respect to the base and relative to the hinge boss as the supporting point, the first and the second fixed contacts can be electrically connected to disconnected (so as to make and break an electrical circuit, respectively) by the movable contact inserted into the bridge member of the operation lever. Any undesirable vertical or horizontal movements of the operation lever can therefore be prevented.

The first and second fixed contacts may be coupled electrically to electrodes of a power source via above-described lamp-holding connector. Thus, the first and the second fixed contacts can be electrically connected and disconnected from each other by the movable contact so that a straight lamp or the like electrically coupled to the fastening connection can be switched on/off.

Other objects, features and advantages of the present invention will become more clear after careful consideration is given to the following detailed description of the preferred embodiments.

BRIEF DESCRIPTION OF THE ACCOMPANYING DRAWINGS

The accompanying drawings illustrate preferred embodiments of the present invention, wherein like reference numerals refer to like structural elements and wherein:

FIGS. 1(*a*)–1(*b*) are cross-sectional views which illustrate the order of assembly for several embodiments of the switches according to this invention;

FIGS. 2(*a*)–2(*b*) are each perspective views which illustrate preferred embodiments of an operation lever portion used in the switches of this invention;

FIGS. 3(*a*)–3(*b*) and 4(*a*)–4(*b*) represent disassembled and partially assembled cross-sectional views of several embodiments of this invention, respectively;

FIGS. 5(*a*)–5(*b*) represent fully assembled cross-sectional views of several embodiments of this invention;

DETAILED DESCRIPTION OF THE PREFERRED EXEMPLARY EMBODIMENTS

Figure 1A:
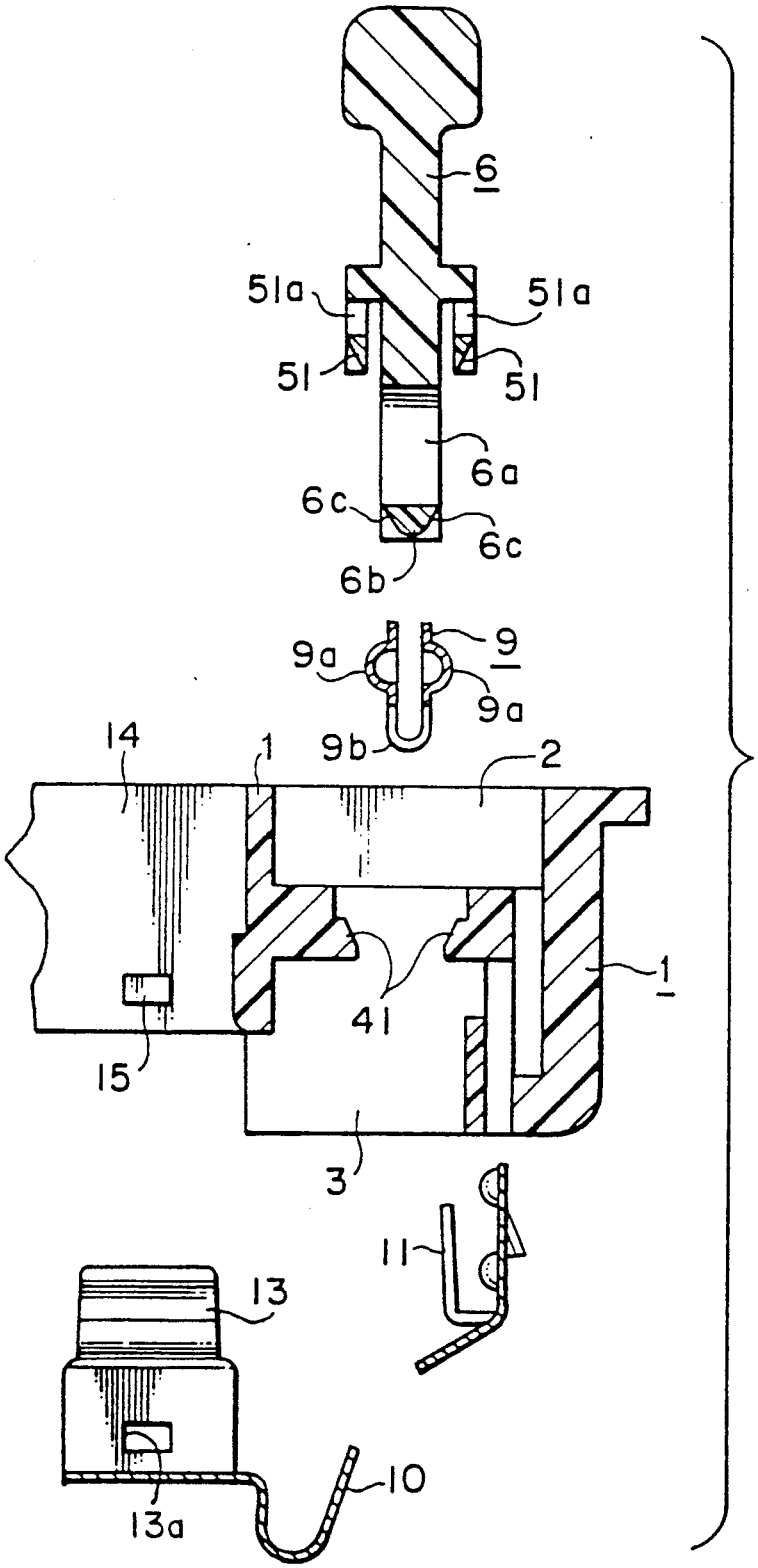
Figure 1B:
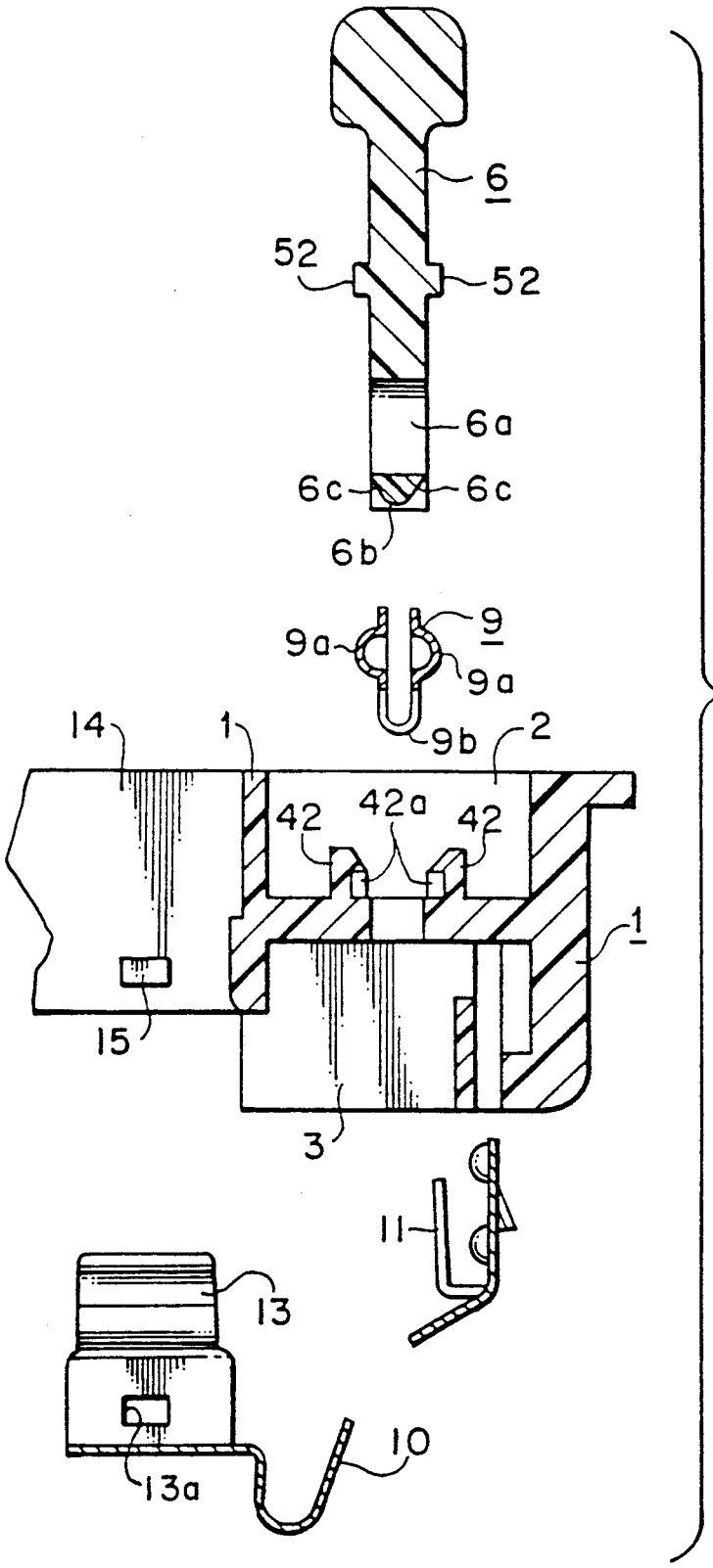
Figure 2A:
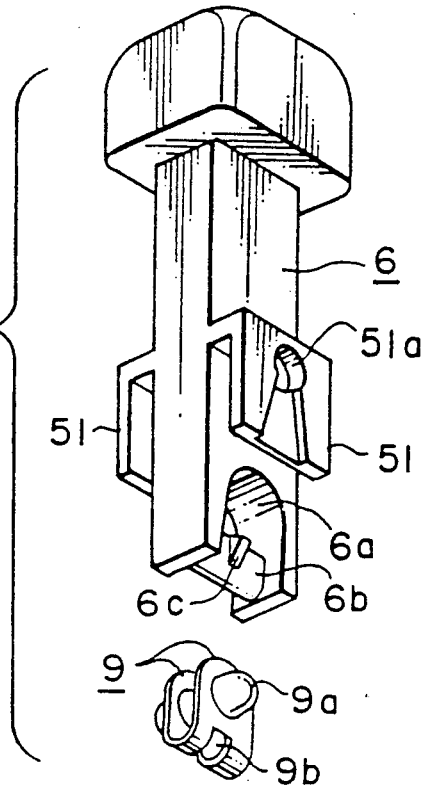
Figure 2B:
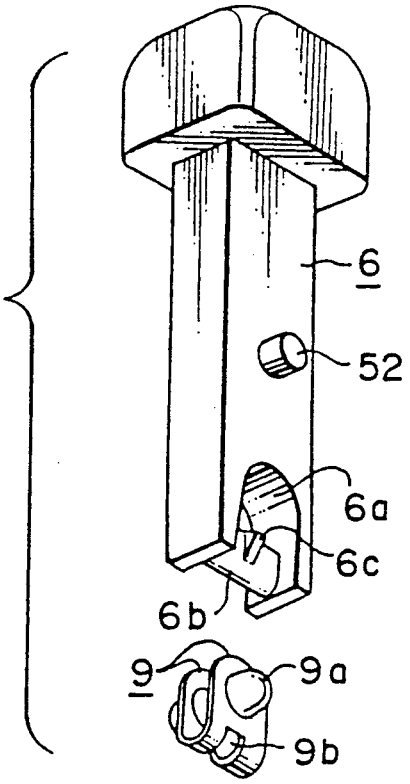

The basic components of a lever switch device according to the present invention are shown in FIGS. 1(*a*)–1(*b*), 3(*a*)–3(*b*), 4(*a*)–4(*b*) and 5(*a*)–5(*b*) which are cross-sectional views illustrating the order of assembly of several respective switch embodiments of this invention, as well as FIGS. 2(*a*)–2(*b*) which illustrate a perspective view of preferred embodiments of an operation lever portion that may be associated operatively with the various embodiments.

Referring to FIGS. 1(*a*)–1(*b*) and 2(*a*)–2(*b*) illustrating exploded views of each of the components, the lever switch device of this invention generally includes an insulating plastic base 1 and hinge bosses 41 confronting each other, disposed between upper and lower spaces 2 and 3 formed in the base 1.

Figure 3B:
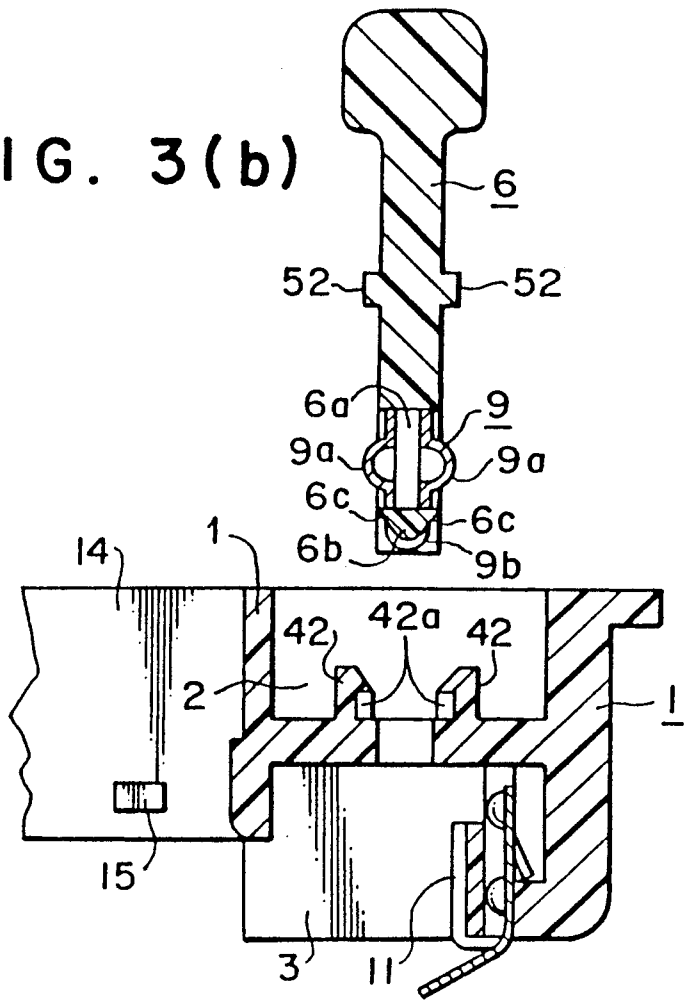
Figure 3A:
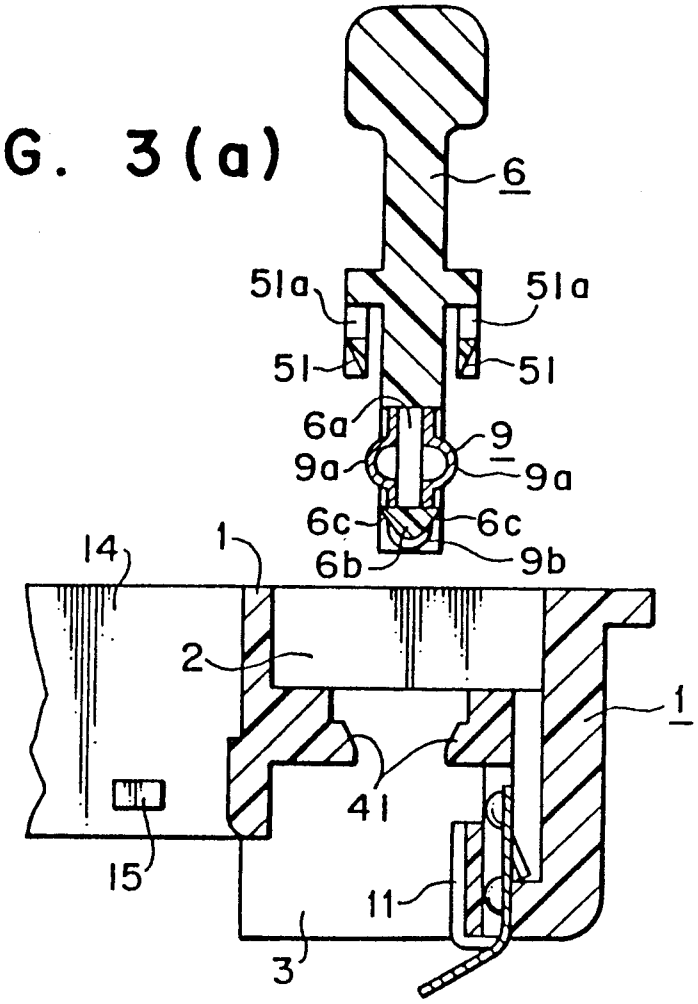
Figure 4A:
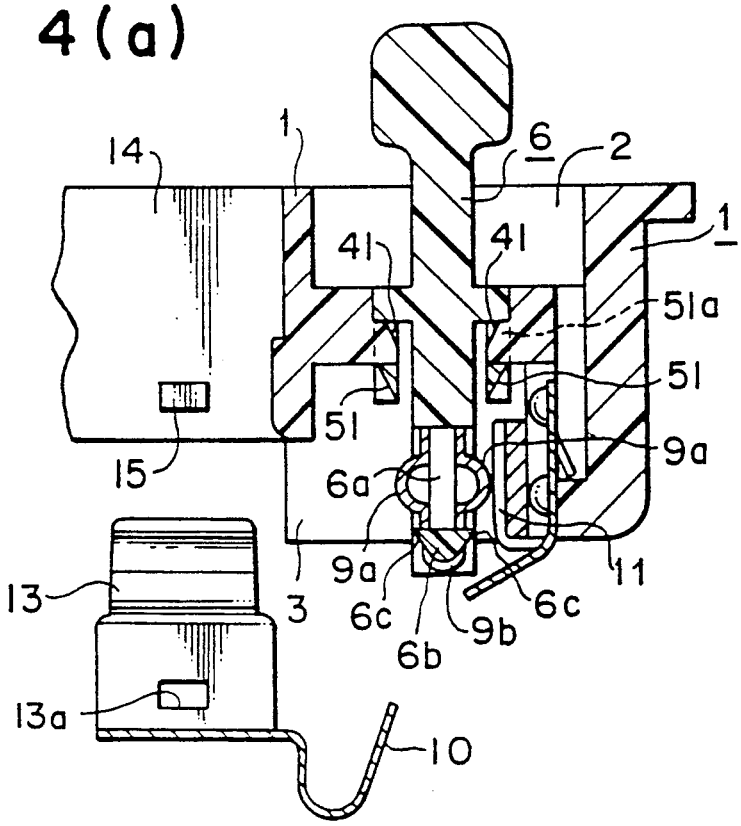
Figure 4B:
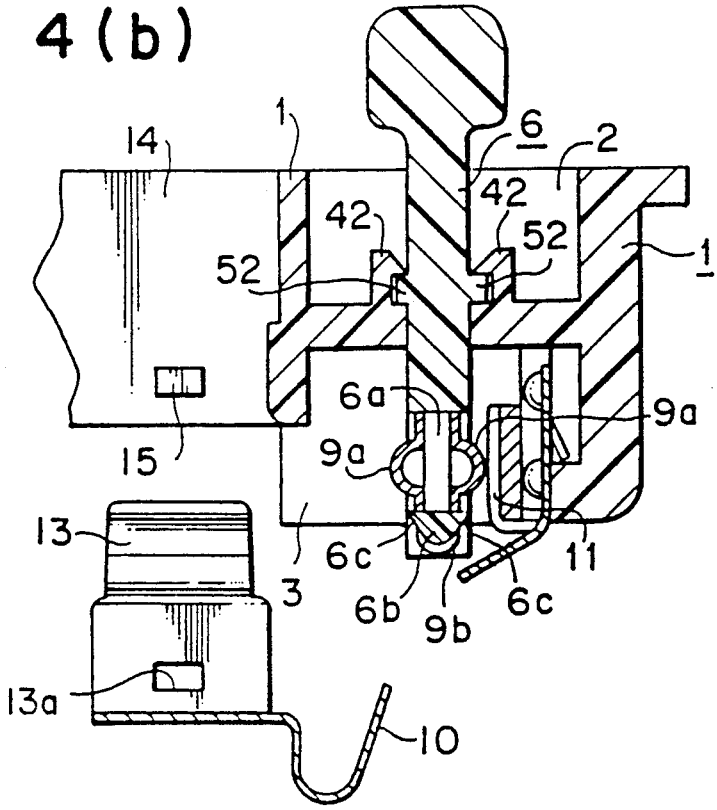

An operation lever 6 is pivotally fastened in such a manner that the hinge bosses 41 are elastically inserted into holes (recessed portions) 51*a* formed in hinge members 51 in confronting relationship to the hinge bosses 41. A bridge member 6*b* connects the lower portions of a hole (recessed portion) 6*a* formed, as shown in FIGS. 2(*a*)–2(*b*) in the lower portion of the operation lever 6. A substantially U-shaped movable contact 9 is pivotally fastened to the bridge member 6*b* and equipped with a pair of contacts 9*a* confronting the holes (recessed portions) 6*a* formed in the operation lever 6. These contacts 9*a* may thus be resiliently displaced with the holes (recessed portions) 6*a* during operation of the lever 6 (i.e., pivotal movement of the operation lever between its various states). A lamp-holding connector 13 integrally equipped with a first fixed contact 10 is inserted into the base 1 in the order as is shown in FIGS. 3(*a*)–3(*d*) and 5(*a*)–5(*d*), respectively. A second fixed contact 11 is then fastened to the base 1 as is shown in FIGS. 3(*a*)–3(*b*) after it has been positioned as is shown in FIG. 1A. A securing portion 15 (see FIG. 11) cooperates with apertures 13*a* in the fastening connectors 13 so that the connectors 13 may be positioned with space 14 of base 1.

Figure 5A:
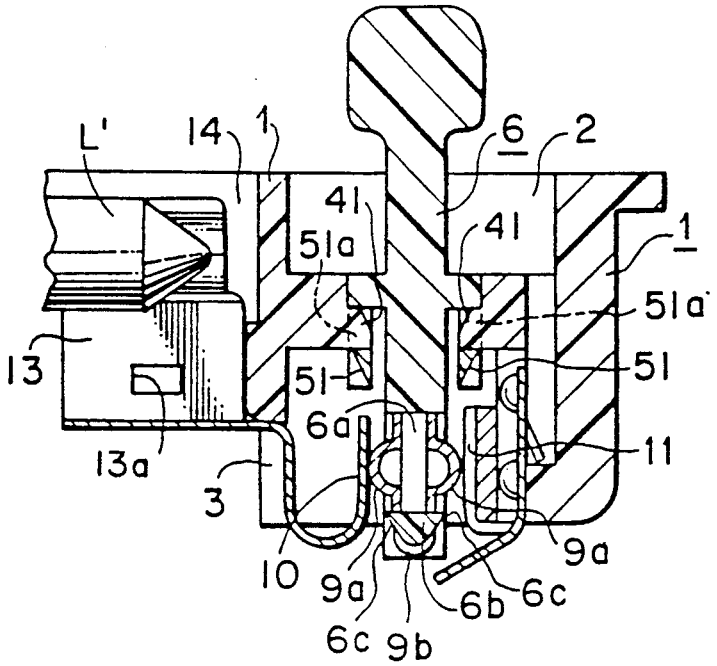
Figure 5B:
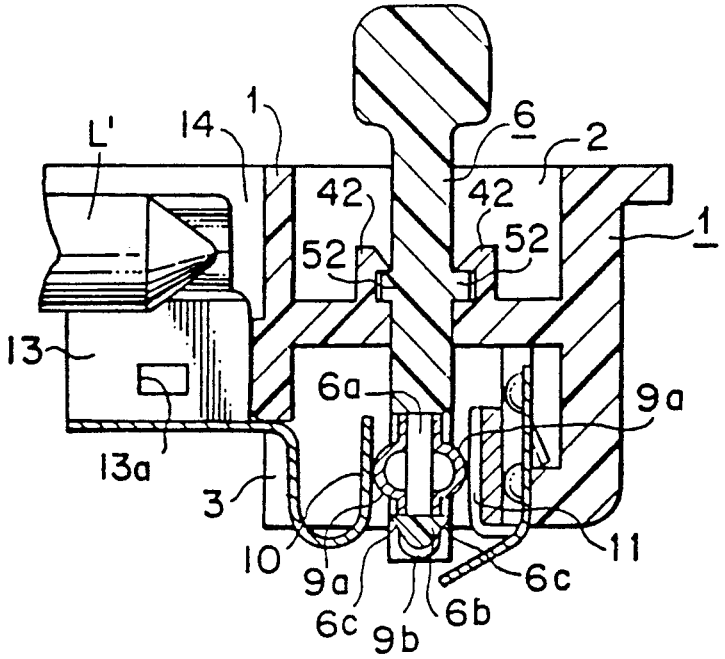
Figure 6:
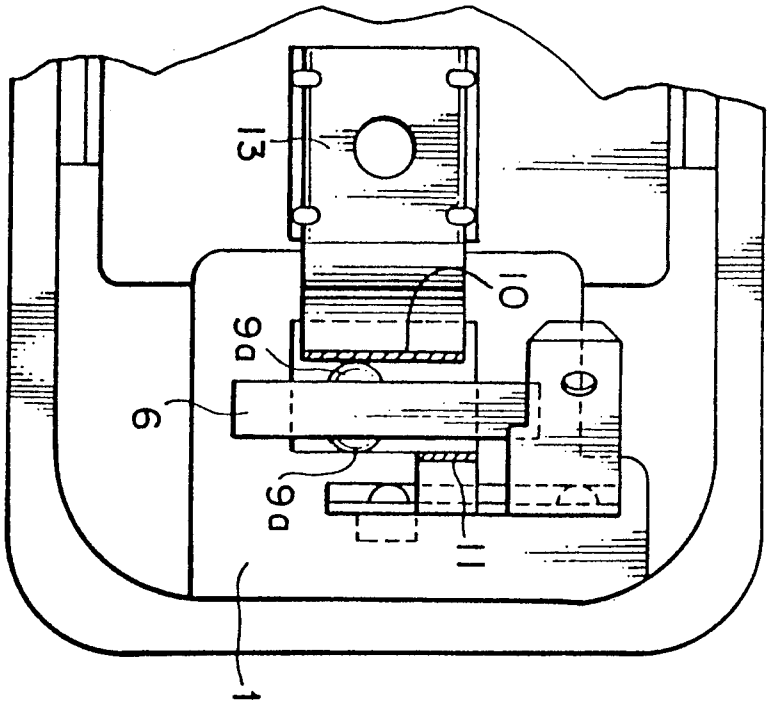
FIG. 6 is a bottom view of the assembled switch shown in FIG. 5(*a*)

FIG. 6 is a bottom view of FIG. 5(*a*) where the same reference numerals represent the same or similar elements. In particular, the first and the second fixed contacts 10 and 11 are illustrated with cross-hatching for a better understanding of the invention.

Referring to FIGS. 2(*a*)–2(*b*), it will be seen that the operation lever includes a securing claw (or a securing hole) 6*c* for securing the movable contact 9. Furthermore, it will be seen that the operation lever 6 shown in FIG. 2(*b*) is similar to the operation lever shown in FIG. 2(*a*) with the principal exception being that pivot pins 52 are provided so as to hingedly cooperate with recesses 42*a* formed in the elastically deformable hinge bosses 42 (see FIGS. 3(*c*)–3(*d*); 4(*c*)–4(*d*) and 5(*c*)–5(*d*)).

Figure 7:
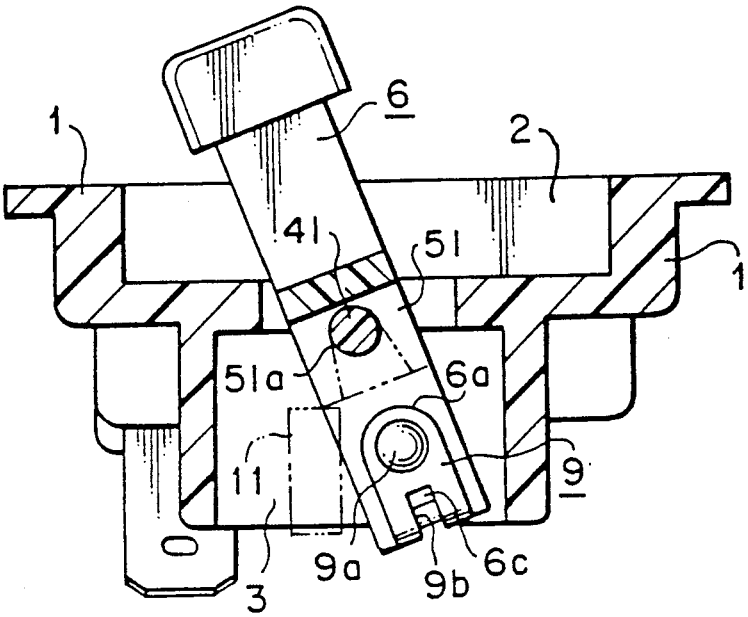
FIGS. 7 and 8 illustrate the switch operation when viewed in cross-section in two different operational states.
Figure 8:
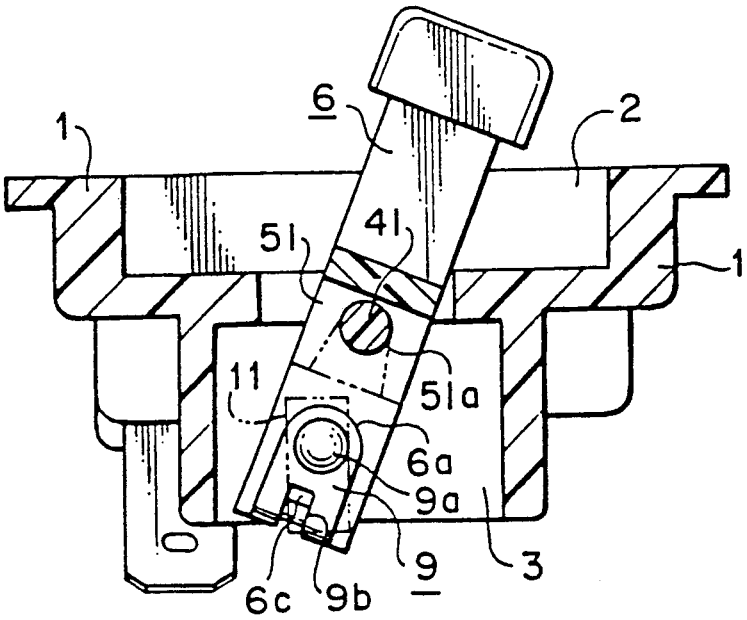

The operation lever 6 according to the present invention is arranged such that it can be pivoted with respect to the base 1 with the hinge boss 41 serving as a supporting point. Thus, as shown in FIGS. 7 and 8, the operation lever may be rotated by the hinge action performed by the hinge member 5 and the hinge boss 41, the first and the second fixed contacts 10 and 11 are, as is shown in FIG. 8, electrically connected to each other by the movable contact 9 inserted into the bridge member 6*b* of the operation lever 6. As a result, a straight lamp L can be switched to an "on" state. On the contrary, when the operation lever 6 is pivoted as is shown in FIG. 7 so as to break the electrical circuit between the fixed contacts 10 and 11, the straight lamp L can be switched to an "off" state.

Any vertical or horizontal movement of the operation lever 6 can be blocked by the holes (recessed portions) 51*a* formed in the hinge members 51 due to the pivotal coupling with respect to the hinge bosses 41. Thus, the operation lever 6 cannot be separated from the base 1 and the movable contact 9 cannot be separated from the operation lever 6 due to its elastic force and the elastic contact action which is exerted by the first fixed contact 10.

Since the lamp-holding connector 13 and the first fixed contact 10 are integrally formed as a one-piece unit (see, FIGS. 3(*a*), 3(*d*), 4(*a*), 4(*d*), 5(*a*) and 5(*d*), the fastening of the first fixed contact 10 as well as the assembly efficiencies of the overall body of the switch can be improved.

When the operation lever 6 is pivoted by connecting either of lamp bases L′ of a straight lamp L which is inserted into the lamp-holding connector 13 to electrodes of a power source, the first and second fixed contacts 10 and 11 can be electrically connected or disconnected by means of the movable contact 9. As a result, the straight lamp L can be switched between on/off states.

Figure 9:
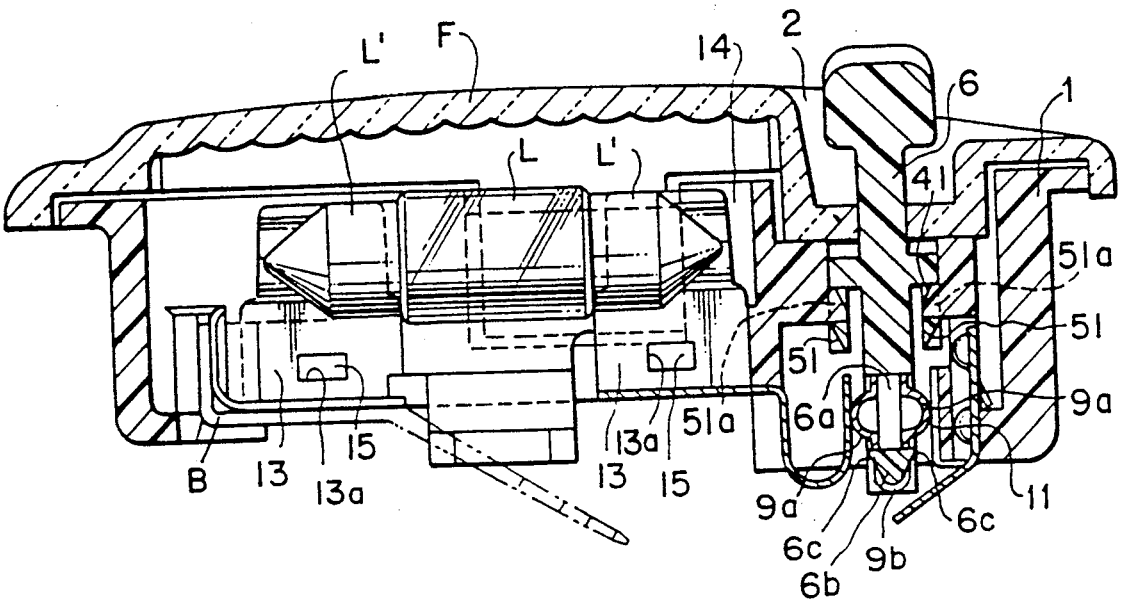
FIG. 9 is a vertical cross-sectional view which illustrates an example in which a lever switch device according to the present invention is embodied in an interior automotive lamp.
Figure 10:
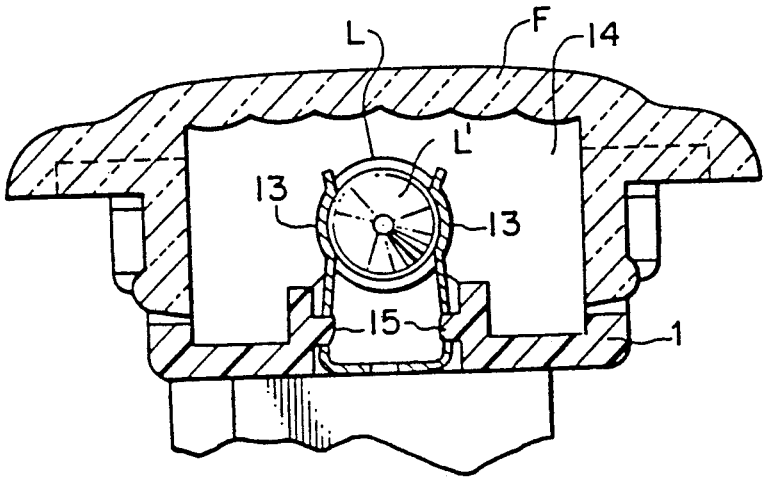
FIG. 10 is a schematic lateral cross-sectional view.
Figure 11:
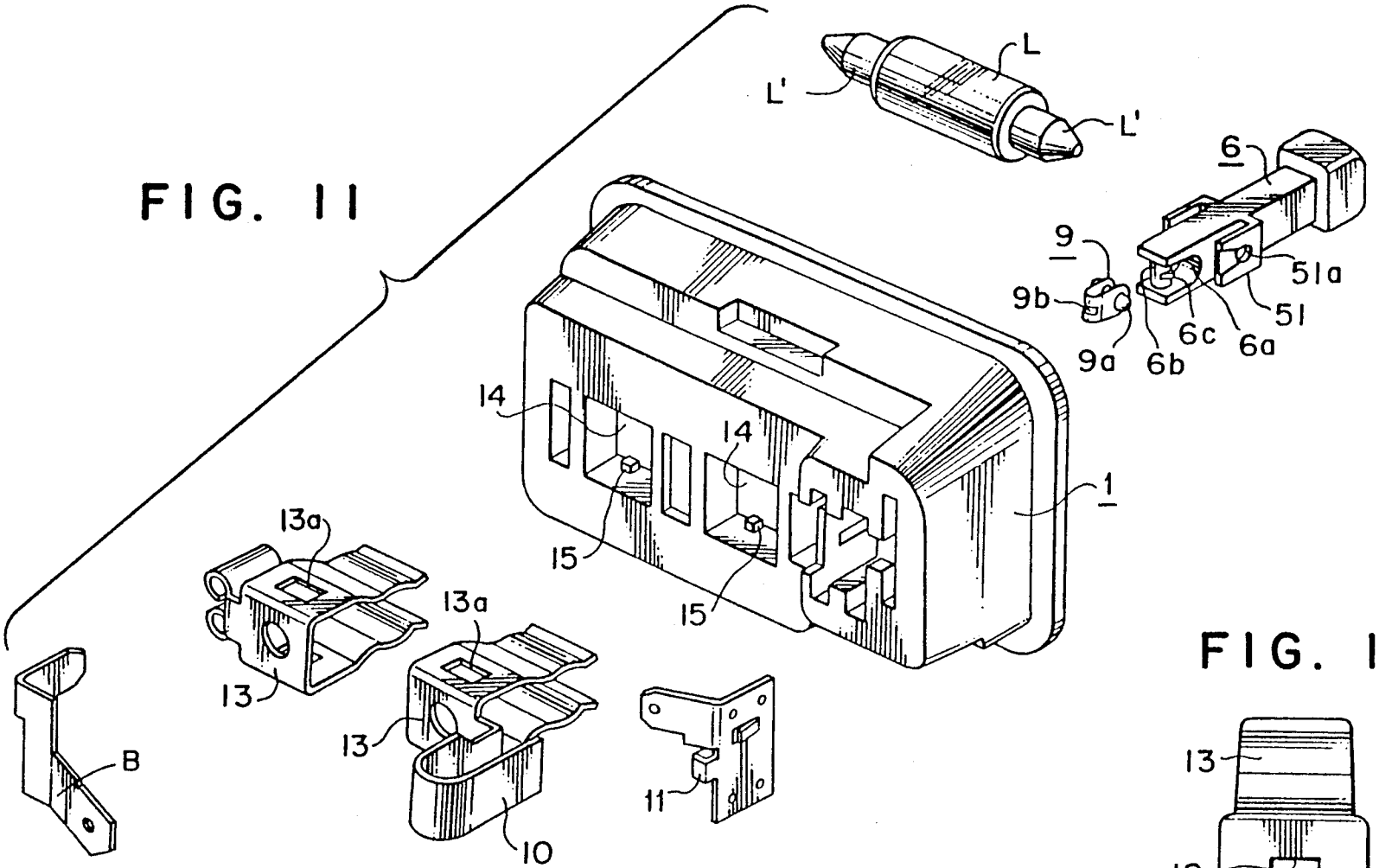
FIG. 11 is an exploded perspective view of the structures shown in FIG. 9.
Figure 12:
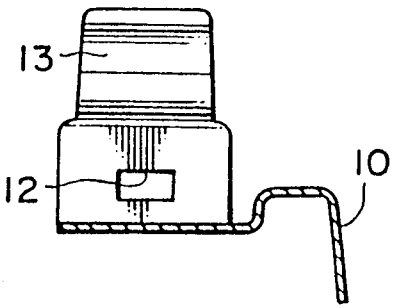
FIG. 12 is a perspective view of the lamp-holding connector.

The present invention can be applied to a switch for interior automotive lamps as is shown in FIGS. 9, 10 and 11 where symbol L represents a lamp, L′ represents bases of the lamp L, and F represents a transparent hood or a lens member. Furthermore, a bus bar B may be coupled operatively to one of the lamp-holding connectors 13. Other reference numerals represent the same or similar elements shown in FIGS. 1(*a*), 3(*a*), 4(*a*) and 5(*a*).

Any undesirable vertical or lateral movements of the operation lever 6 can be blocked by the hinge bosses 41 disposed corresponding to the holes or the holes (recessed portions) 51*a* or the hinge bosses 52 disposed corresponding to the holes (recessed portions) 42*a* of the hinge elastic members 42. Therefore, the arrangement of each of the components such as the operation lever 6 and the movable contact 9 can be reliably maintained for a long time.

In particular, since the inner surfaces of the contact portions 9*a* of the movable contact 9 according to the present invention confront each other at the hole (recessed portion) 6*a* formed in the operation lever 6, the elastic resilience force of the contact portions 9*a* will not be deteriorated. Therefore, the fixed contacts 10 and 11 can be satisfactorily electrically connected or disconnected with each other even if the fixed contacts 10 and 11 are not made of elastic materials.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A lever switch device comprising:

an insulating base formed of a plastics material which defines a upper and lower switch operation spaces, a pair of confronting hinge bosses interposed between said upper and lower switch operating spaces, and a lamp-mounting space;

an operation lever having upper and lower ends and being pivotally coupled to said hinge bosses such that said upper end extends into said upper switch operation space and a lower end extends into said lower switch operating space, whereby said operation lever may be pivotally moved between first and second states; wherein said lower end of said operation lever includes a bridge portion having a hole therein; and wherein said operation lever further includes a substantially U-shaped movable contact having terminal ends which establish an opposed pair of resilient contact members, said U-shaped contact being mounted to said bridge portion of said lower end of said operation lever such that said opposed pair of resilient contact members are disposed adjacent to said hole through said lower end of said operation lever so as to be resiliently displaceable therewithin;

said lever switch further including;

a lamp-holding connector mounted to said base for holding a lamp within said lamp-mounting space; and first and second fixed contacts forming an electrical circuit through the lamp held by said lamp-holding connector and disposed within said lower switch operating space such that said resilient contact members of said U-shaped movable contact makes electrical contact with said first and second fixed contacts when said operation lever is in said first state, and breaks electrical contact between said first and second fixed contacts when said operation lever is in said second state, whereby an electrical circuit is made and broken to turn said lamp held by said lamp-holding connector on and off, respectively.

2. A switch as in claim 1, wherein said operation lever includes a pair of opposed, elastically deformable hinge members each of which defines a recess for accepting a respective one of said hinge bosses, whereby said operation lever is pivotally coupled to said base.

3. A switch as in claim 1, wherein said operation lever includes a pair of hinge pins, and said hinge bosses are elastically deformable and define a pair of recesses for accepting a respective one of said hinge pins, whereby said operation level is pivotally coupled to said base.

* * * * *